US008020841B2

(12) United States Patent
Venäläinen

(10) Patent No.: US 8,020,841 B2
(45) Date of Patent: Sep. 20, 2011

(54) FASTENER FOR A CAR-BODY STRAIGHTENING DEVICE

(75) Inventor: Olavi Venäläinen, Kuopio (FI)

(73) Assignee: Autorobot Finland Oy, Kuopio (FI)

( * ) Notice: Subject to any disclaimer, the term of this patent is extended or adjusted under 35 U.S.C. 154(b) by 906 days.

(21) Appl. No.: 11/721,076

(22) PCT Filed: Dec. 2, 2005

(86) PCT No.: PCT/FI2005/050443

§ 371 (c)(1),
(2), (4) Date: Jan. 28, 2008

(87) PCT Pub. No.: WO2006/061457

PCT Pub. Date: Jun. 15, 2006

(65) Prior Publication Data

US 2009/0224452 A1 Sep. 10, 2009

(51) Int. Cl.
*B23Q 3/00* (2006.01)

(52) U.S. Cl. ..... 269/17; 29/281.1; 29/897.2; 254/8 C; 72/457

(58) Field of Classification Search ..... 269/17; 29/281.1, 897.2, 465–468, 787, 795; 72/457, 72/705; 254/2 B, 7 B, 10 B, 10 R, 8 B, 8 C
See application file for complete search history.

(56) References Cited

U.S. PATENT DOCUMENTS

| | | | | |
|---|---|---|---|---|
| 1,879,979 A * | 9/1932 | Countryman | ..... | 72/305 |
| 4,505,145 A * | 3/1985 | Bergstrom et al. | ..... | 72/457 |
| 4,519,236 A * | 5/1985 | Celette | ..... | 72/457 |
| 4,824,303 A * | 4/1989 | Dinger | ..... | 411/79 |
| 5,253,509 A * | 10/1993 | Venalainen | ..... | 72/457 |
| 6,182,493 B1 * | 2/2001 | Weschler | ..... | 72/457 |
| 7,017,384 B2 * | 3/2006 | Espinosa | ..... | 72/457 |

FOREIGN PATENT DOCUMENTS

| | | |
|---|---|---|
| DE | 19714918 | 11/1997 |
| FI | 109409 B | 7/2002 |
| GB | 2030633 A | 11/2004 |

* cited by examiner

*Primary Examiner* — George Nguyen

(74) *Attorney, Agent, or Firm* — Cozen O'Connor

(57) ABSTRACT

A fastener (12) for a car-body straightening device (10), by means of which fastener (12) a vehicle is fastened to a straightening table (11) of the car-body straightening device (10) for the time of straightening work. The fastener (12) comprises an arm part (21), which provides additional support when during the car-body straightening work a force is applied to the area to be straightened, and a fastening device (24) for fastening the fastener (12) to the car to be straightened. The arm part (21) is movable in the fastener (12) and the fastener (12) can be placed moveably on a beam (13) of the car-body straightening table (11), and locked on said beam in a desired position. the fastener (12) comprises an upper frame part (16) and a lower frame part (17) of a fastener frame (15) and, between them, guides (18) to which an intermediate part (19) is connected floatingly. The fastening and the locking are carried out by means of a wedge part (20) such that in the locking the intermediate part (19) is pressed against the arm part (21) and against the beam (13).

7 Claims, 7 Drawing Sheets

Section
I-I

FASTENER FOR A CAR-BODY STRAIGHTENING DEVICE

The invention relates to a fastener for a car-body straightening device.

Car-body straightening devices are known in the state of the art for performing the straightening of the damaged body of a car body on a so-called straightening table. The vehicle is driven onto the straightening table of the straightening device and fastened to fasteners provided on the straightening table such that straightening pull can be applied to the area to be straightened in the car body during the straightening work. The car is attached to the straightening table by means of fasteners and lifted to a desired working height. Straightening pull can be applied to the area to be straightened, for example, using a hydraulic tool, so that the hydraulic tool applies a force, for example, through a chain or another equivalent means to the area to be straightened. A gripper can be attached to the chain, the gripper being connected, for example, to the window arch of the car.

The basic fasteners fastened to the car body are generally fastened to the lower edge of the sill beam of the car and they are so-called gripper fasteners comprising two jaws, between which the lower edge of the sill beam of the car is placed.

Today's vehicles often comprise a cover plate of synthetic material in connection with the lower sill beam for protecting the sill beam against stone impacts and corrosion. To allow coupling to the lower edge, said protective plate shall be removed and the rivets shall be detached. After straightening, the protective plate shall be replaced and riveted again in place. The procedure is time-consuming.

Moreover, the fastening of the state-of-the-art fasteners to a transverse beam of the straightening table takes a lot of time because locking and unlocking takes place by tightening and loosening separate screws. The patent application particularly relates to a fastener that comprises a separate arm part connected to the frame of the fastener and provided with a support point at the end of the arm part enabling the vehicle to be supported from below during straightening pull in particular when the straightening pull is directed downwards. The vehicle can also be lifted using the arm part. The arm part is movable to different positions with respect to the frame of the fastener. In the arrangements of the state of the art, it has been necessary to fasten the above-mentioned arm part to the frame of the fastener by means of a separate fastening means of its own to achieve a desired position for the arm part in the fastener.

This patent application discloses an improvement for speeding up the fastening operation.

The patent application discloses a new so-called basic fastener arrangement, which makes it possible to fasten a vehicle to a straightening table for the time of straightening work. The patent application proposes the use of a fastener that comprises a frame part and downwardly extending guides, at the end of which there is a lower frame part comprising a wedge part, i.e. a wedge device, in its connection. In accordance with the invention, the guide parts are passed through a floating intermediate part, which serves as a structural part attached to an arm part above and which intermediate part additionally serves as a structural part pressed against the upper surface of a beam below when the wedge part is moved to a locked position. In the arrangement in accordance with the invention, a fastening means, such as a gripper, to be fastened to the vehicle's sill beam edge is attached to the frame part. The gripper comprises fastening jaws to be fastened to an edge of the sill beam. Advantageously, the gripper jaws are fastened to an upper edge of the sill beam, which does not comprise a separate, slowly removable protective covering, as the lower sill structure often does. The gripper frame is attached to the fastener using screw means located in the frame of the fastener. The frame of the gripper comprises an elongate frame part, so that the gripper can be placed in the screw means after the vehicle has first been lifted using the lifting device of the straightening table to a working height such that a pad provided in the arm part of the fastener will be located at the lifting point under the vehicle. The end of the arm part comprises a fastening point for the bottom of the vehicle, for example, a pad, which will be placed against the bottom of the vehicle. Instead of a pad, the support point of the arm may also be formed of a separate make-specific fastening means to enable fastening to a fastening point under the vehicle.

Thus, this patent application discloses a novel type of fastener in the straightening work of a vehicle, which fastener allows the vehicle to be fastened to a straightening table for the time of the straightening work, which fastener operates on the principle of quick lock fastening, so that the fastener can be attached to a beam of the straightening table using a wedge means and, using said same means, the arm part of the fastener allowing the vehicle to be supported can be attached simultaneously to the fastener frame so as to be in a desired position. In that connection, the support/attachment point in the arm is in a correct position with respect to the support point under the vehicle. In the structure of the invention, the frame of the gripper to be fastened to the vehicle's sill beam edge is attached to a side surface of the fastener frame and in a such way that said gripper can be adjusted in its height when the vehicle has first been lifted on support of a pad provided in the arm to a desired working height using the lifting device of the straightening table.

The fastener according to the invention is characterized by what is stated in the claims.

In the following, the invention will be described with reference to some advantageous embodiments of the invention illustrated in the figures of the accompanying drawings, but the invention is not meant to be limited exclusively to these embodiments.

Figure 1A:
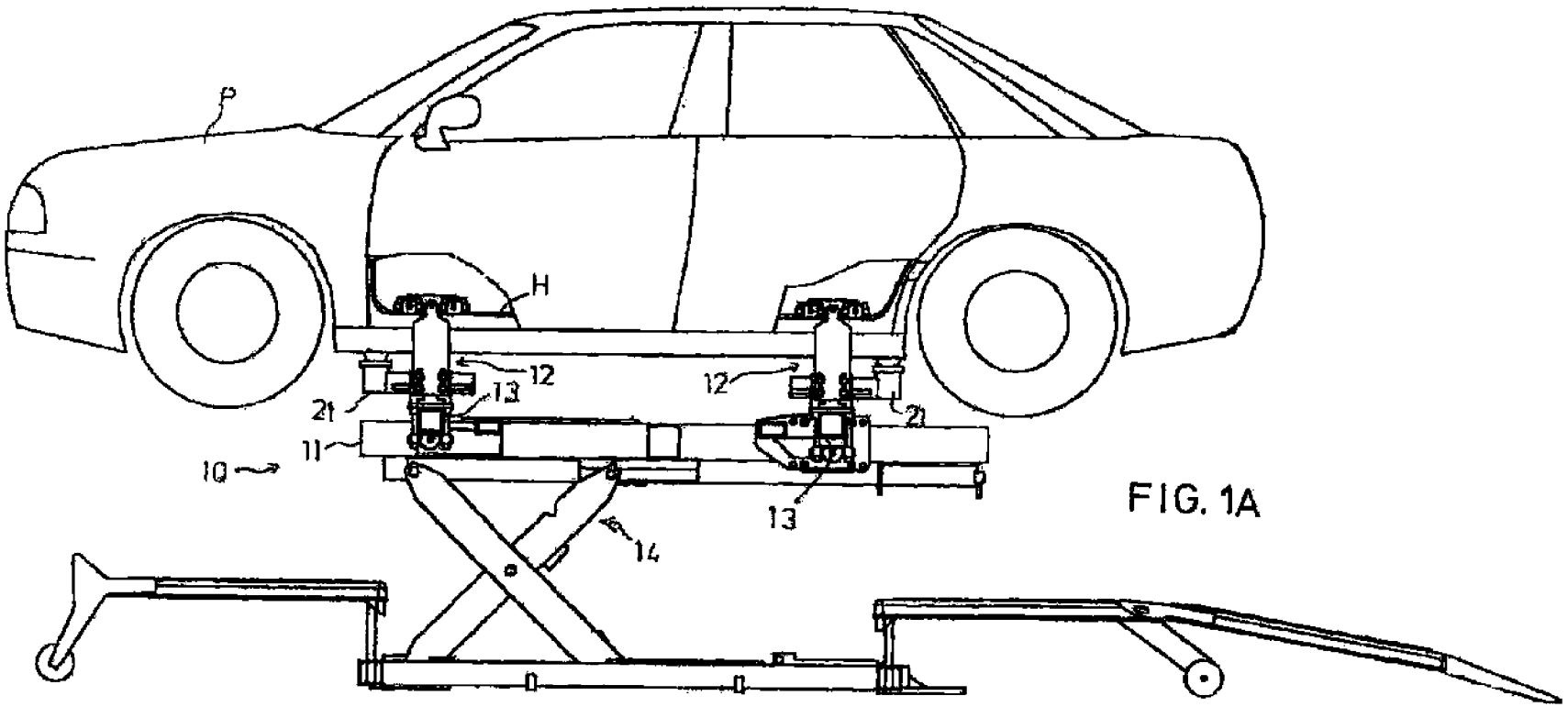
FIG. 1A shows a device arrangement in accordance with the invention in connection with a vehicle straightening table and, as shown in the figure, a vehicle is fastened to the straightening table.

In FIG. 1A, a vehicle P has been fastened to a straightening table 11 of a vehicle straightening device 10 by means of a fastener 12 in accordance with the invention. The fastener is located on a beam 13, advantageously a transverse beam, of the straightening table 11 and it is attached to it. The straightening table 11 has four beams 13 and each beam 13 has its own fastener 12, which is also called a basic fastener. Thus, for the time of the straightening work, the vehicle is fastened to the straightening table 11 at four locations by means of the fasteners in accordance with the invention. The straightening table 11 and the vehicle fastened to it can be lifted to a desired working height using a lifting device 14. A straightening force can be applied to the body of the vehicle by means of a separate pull and/or push tool (not shown).

Figure 1B:
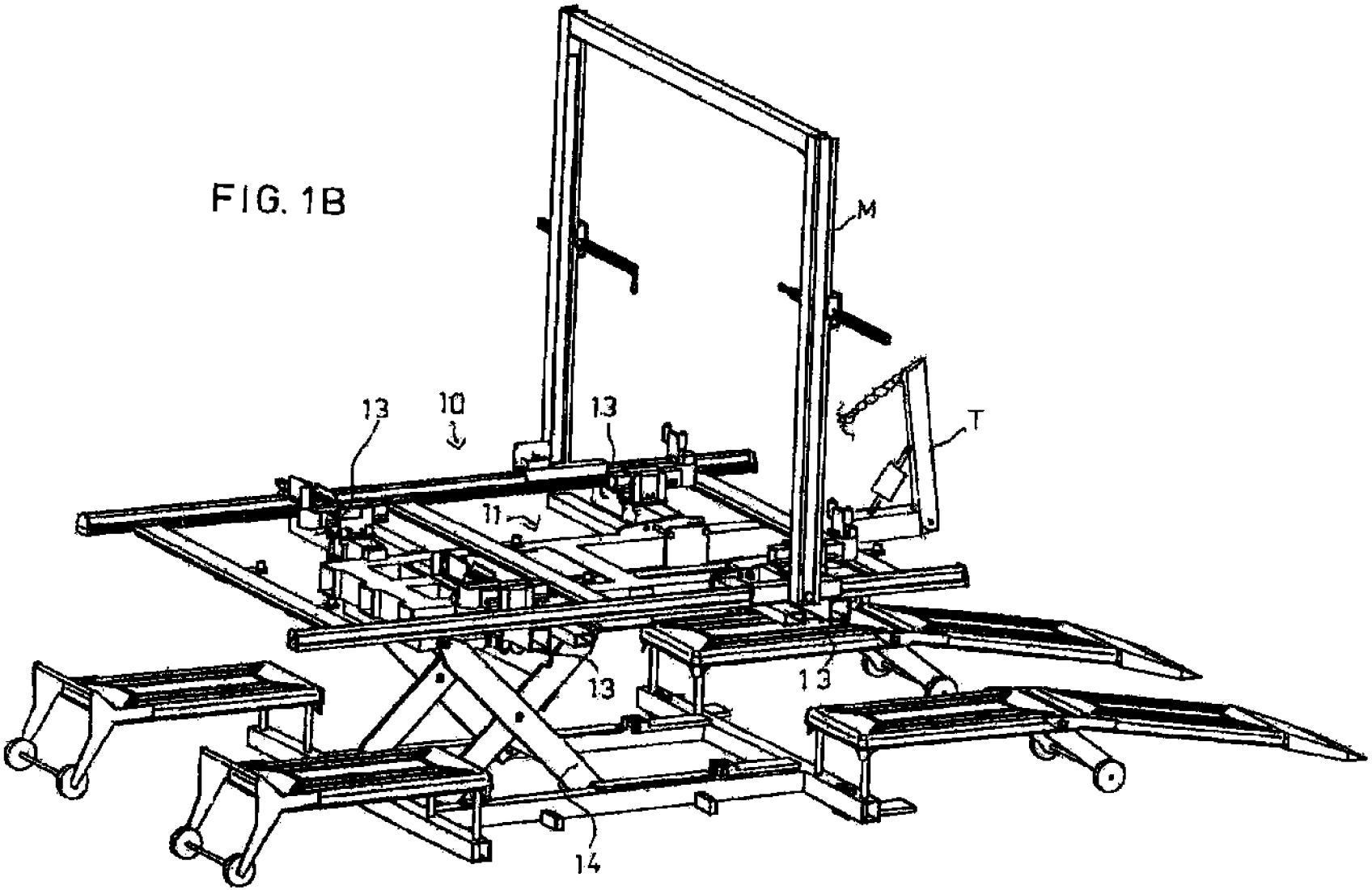
FIG. 1B is an axonometric view of car-body straightening equipment. The body of the vehicle can be measured by a measuring apparatus, and by means of a tool T it is possible to apply pull, for example, using a chain, to the area to the straightened.

FIG. 1B is an axonometric view of a vehicle straightening table. A tool T can be used for applying pull through a chain to the area to be straightened, and a measuring device M can be used for measuring the adequacy of the straightening pull and the fact that the car body is restored to its correct measurements.

Figure 2A:
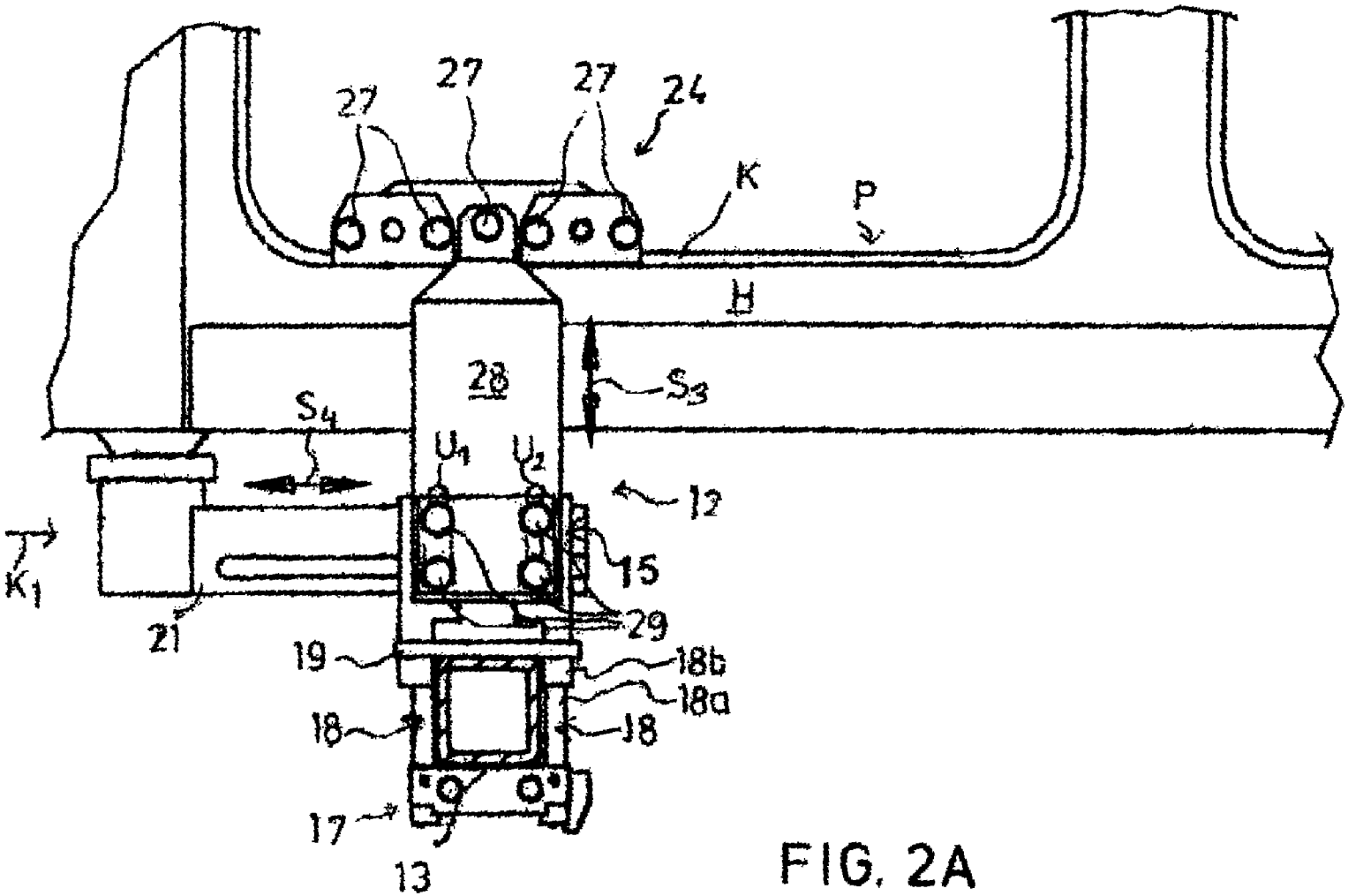
FIG. 2A shows the fastener in accordance with the invention fastened to the upper edge of the vehicle's sill beam.
Figure 2B:
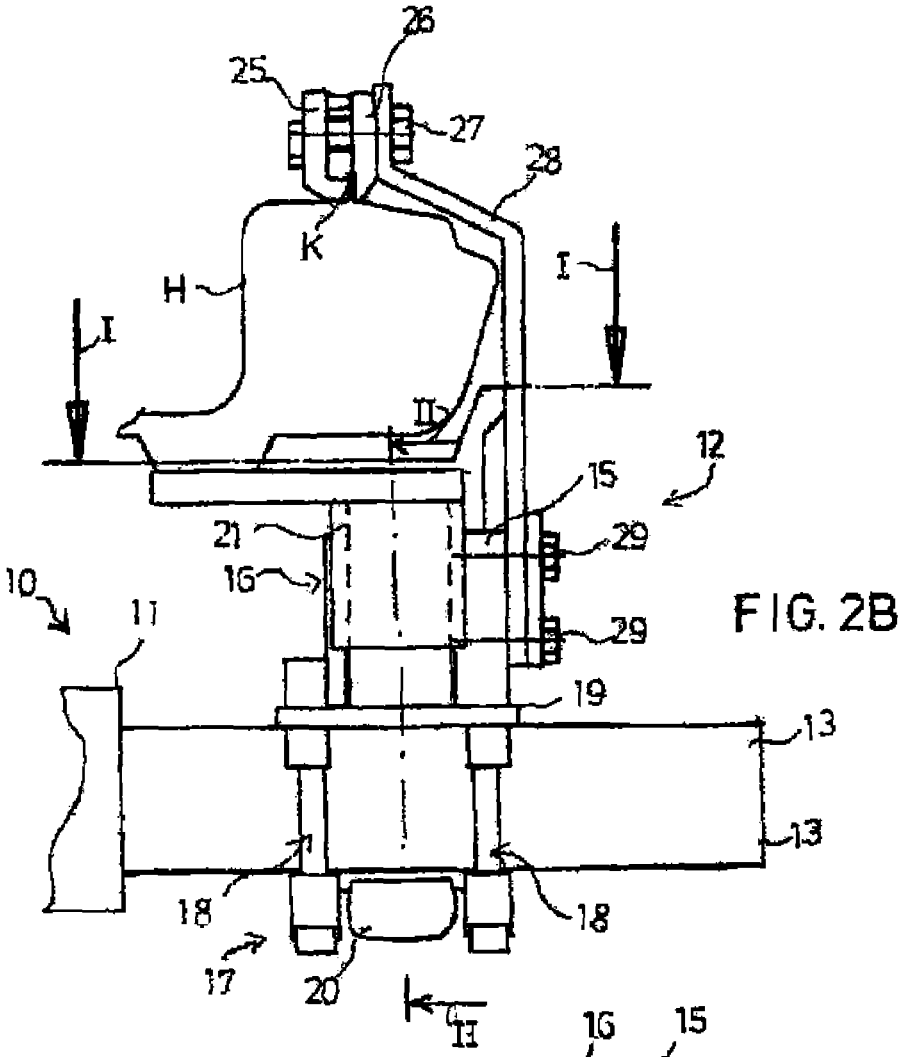
FIG. 2B shows the device in the direction $K_1$ of FIG. 2A.
Figure 2C:
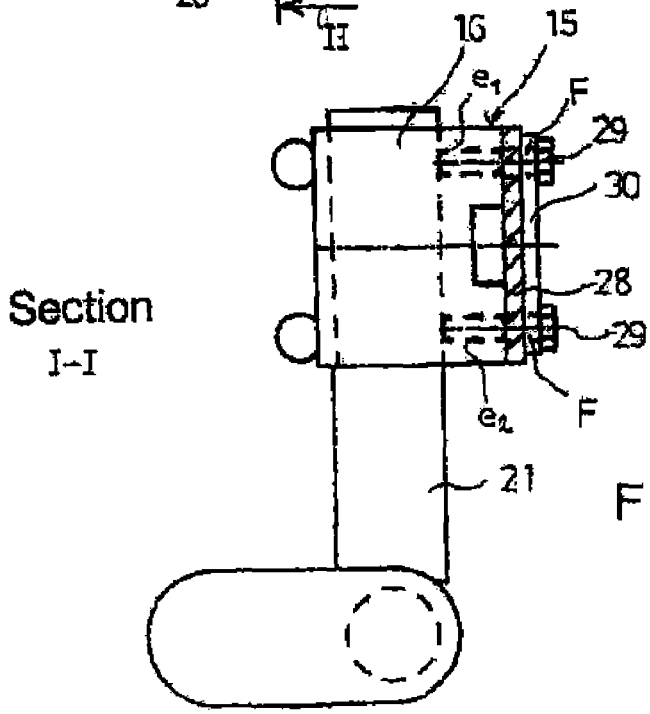
FIG. 2C is a sectional view taken along the line I-I in FIG. 2B.
Figure 2D:
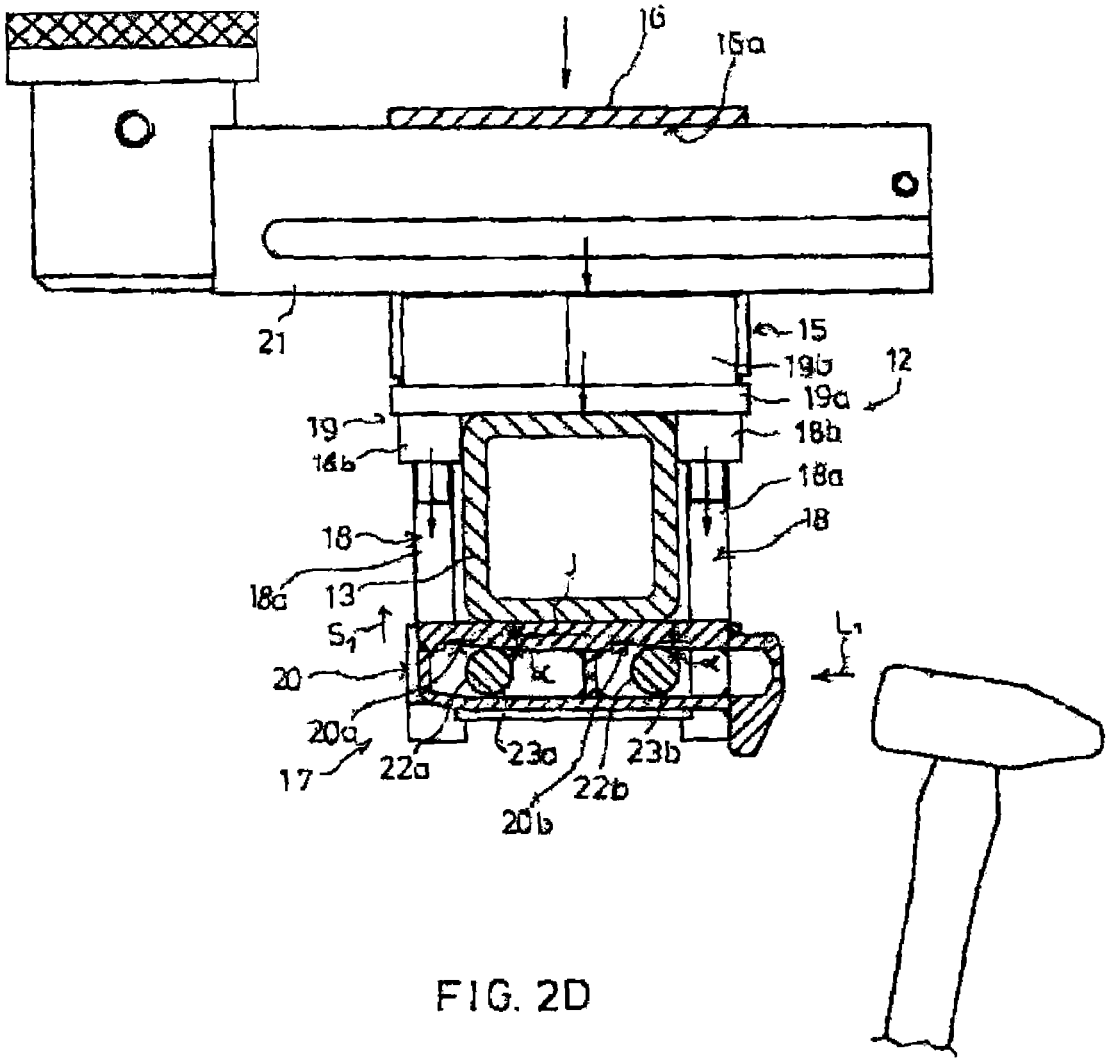
FIG. 2D is a sectional view of the fastener taken along the line II-II in FIG. 2B.

FIG. 2A shows the fastener 12 in accordance with the invention fastened to an upper edge K of a sill beam H of the car body. The fastener 12 has been disposed on a beam 13 of the straightening device 10 of the car body P. FIG. 2B shows the device of FIG. 2A viewed in the direction of the arrow $K_1$. FIG. 2C is a sectional view taken along the line I-I in FIG. 2B. FIG. 2D is a sectional view taken along the line II-II in FIG. 2B.

As shown in FIGS. 2A-2D, the fastener 12 comprises a fastener frame 15. The fastener frame 15 comprises an upper frame part 16 and a lower frame part 17 and guides 18 or equivalent connecting said frame parts and comprising four bolts. A floating intermediate part 19 is guided along the guides 18. The intermediate part 19 can move freely along the guides in the vertical direction. The function of the guides 18 is only to guide the intermediate part 19. The guide 18 is formed of a bolt part 18*a* and an end sleeve 18*b* attached to the bolt part and connected to the upper frame 16. The sleeve part 18*b* itself is passed with clearance through the holes D of the intermediate part 19. The lower frame part 17 comprises a movable wedge part 20. An arm part, i.e. an arm 21, of the fastener 12, by which the vehicle can be supported from below, is located between the intermediate part 19 and an upper edge 16*a* of the upper frame part 16, and the beam 13 of the straightening table 11 is located between the intermediate part 19 and the lower frame part 17 of the fastener 12. The intermediate part 19 is guided freely i.e. floatingly along the guides 18, i.e. it can move freely upwards and downwards along the guides 18. The guides 18 and particularly the sleeve part 18*b* are passed through the clearance holes D of the intermediate part 19.

The lower frame part 17 comprises a wedge part 20 that is movable with respect to the lower frame part 17 such that wedge surfaces 20*a*, 20*b* of the wedge part 20 will be against backing surfaces 22*a*, 22*b* of the lower frame part 17, which backing surfaces 22*a*, 22*b* are formed of the surfaces of rod parts 23*a* and 23*b*. In the embodiment there are two rod parts 23*a*, 23*b* (FIG. 2D). Similarly, the wedge part 20 comprises two wedge surfaces 20*a*, 20*b* having a wedge angle $\alpha$. One wedge surface 20*a* cooperates with one rod part 23*a* and the other wedge surface 20*b* cooperates with the other rod part 23*b*. The wedge part 20 is struck from the side, so that it is pressed at its wedge surfaces against the rod parts 23*a*, 23*b* and moves along the rod parts, as shown in the figure, and additionally upwards in the direction $S_1$ over a distance corresponding to a gap of less than 1 mm. When the gap between the surface of the beam 13 and the surface of the wedge part has been removed in the locking movement, the guides 18 are subjected to a downward pull and the arm part 21 is pressed between the upper edge 16*a* of the upper frame part and the upper surface of the intermediate part 19 and, at the same time, the intermediate part 19 is pulled into contact with the upper surface of the beam 13. When the gap between the wedge part and the lower surface of the beam 13 has been first removed in the locking movement, the guide parts 18 are subjected to a pull and the arm part 21 is pressed against the intermediate part 19 and, the intermediate part 19 being floating i.e. freely movable, the structure is pressed against the upper surface of the beam 13. The striking of the wedge part 20 is indicated with the arrow $L_1$. The tightening taking place in the locking is indicated with the arrow J. When the wedge part is moved in the direction $L_1$ by striking, the wedge part 20 rises upwards in the direction $S_1$ and the arm part 21 is locked in place in its fastener 12, and the fastener 12 is locked to the beam 13 at a desired location on the beam 13 of the straightening table 11 of the straightening device 10, so that the fastener 12 is so placed in connection with the car to be straightened that a gripper is enabled to be coupled to the edge K of the sill box of the car. The arm part 21 is pressed between the intermediate part 19 and the upper surface 16*a* of the upper frame part 16, and the wedge part 20 and the intermediate part 19 are pressed against the beam 13 of the straightening table. In this manner, the same locking movement $L_1$ locks both the arm part 21 of the fastener 12 in place in the fastener 12 in a desired projecting position (arrow $S_4$) and the fastener 12 in a desired position on the beam 13, advantageously a transverse beam, of the straightening table 11.

In accordance with the invention, the lower frame part 17 of the fastener 12 is thus guided on the guides 18. The lower frame 17 can additionally be attached to the guides 18 in a desired position using screws R. In this manner, the lower frame 17 can be placed in an initial position. The lower frame 17 of the fastener 12 comprises the rods 23*a*, 23*b*, which cooperate with the wedge part 20 and are fixedly attached to side frame parts 24*a*, 24*b*. The wedge part 20 is arranged to move between the side frame parts 24*a*, 24*b*, as shown in the figures. When the wedge part 20 is used for carrying out the locking of the arm part 21 in the fastener 12 and the locking of the fastener 12 to the beam 13 of the straightening table 10, it takes place by striking the wedge part 20 in the direction indicated by the arrow $L_1$ and the opening movement takes place in the opposite direction. In that case, the wedge part 20 is struck at its other end.

As shown in the figure, the fastener 12 comprises a fastening device 24, such as a gripper. The gripper 24 comprises jaws 25 and 26, which can be opened and closed by means of a screw device 27 so that the gripper 24 is coupled to the upper edge K, such as the edge in the sill box H of the car. The gripper 24 comprises a downwardly extending frame part 28 and grooves $U_1$ and $U_2$ provided in said frame part and to be placed into connection with screws 29 provided in the fastener. Said downwardly extending grooves $U_1$ and $U_2$ make it possible that the gripper 24 can be placed on the edge K (arrow $S_3$) after the vehicle (P) has first been lifted upwards on support of a fastening cushion provided on the arm 21 of the fastener 12 and using the lifting device 14 of the straightening device 10. By tightening the screws 29, the gripper 24 can be locked in a desired position with respect to the frame 15 of the fastener 12. Between the head of the screw 29 and the downwardly extending frame part 28 of the gripper 24 there is an intermediate plate 30 comprising holes F for the screws 29. The screws 29 are passed through the holes F into threaded holes e1 provided in the frame 15 of the fastener 12.

Figure 3A:
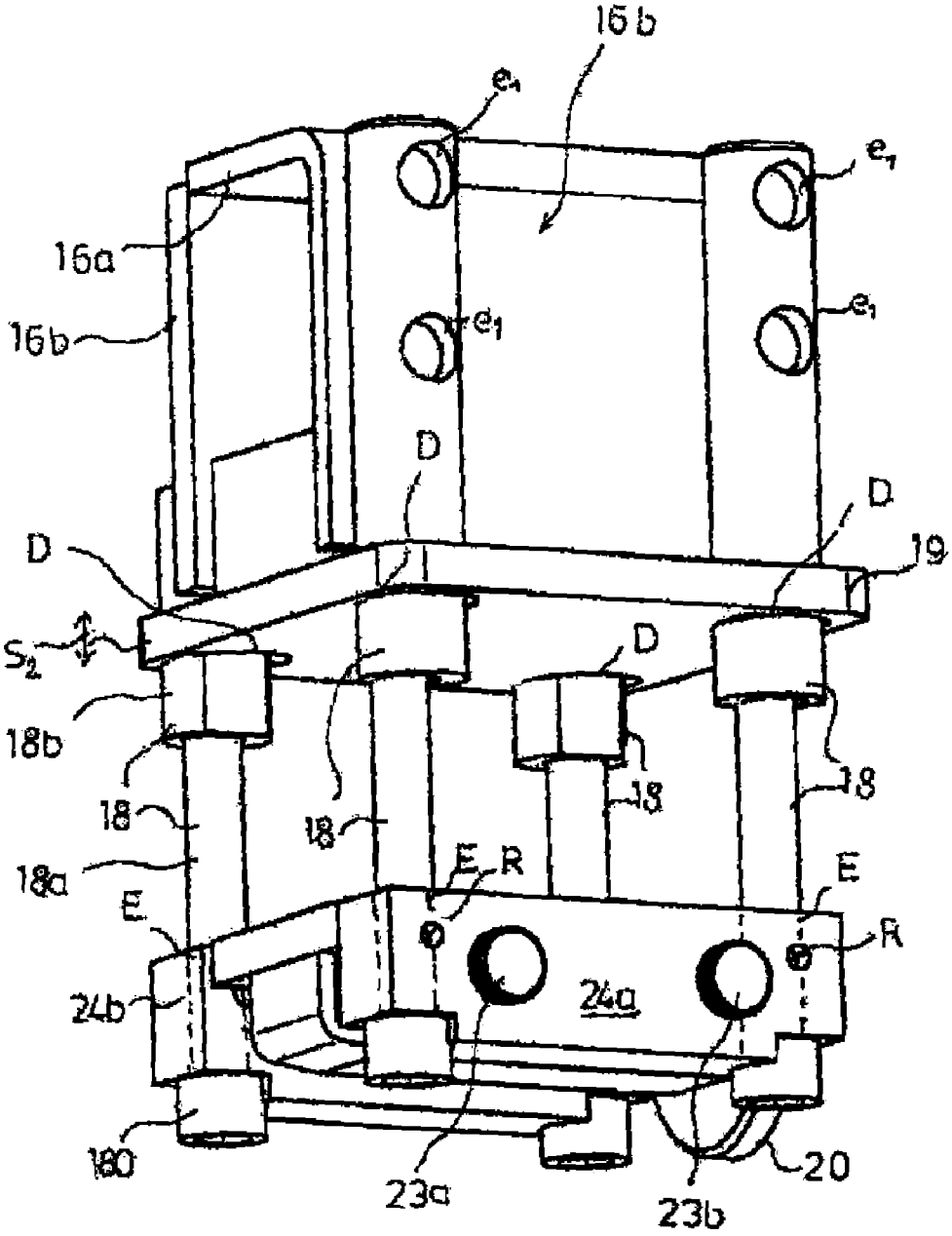
FIG. 3A is a separate axonometric illustration of the fastener. The figure does not show a gripper part and an arm part.

FIG. 3A is a separate illustration of the fastener 12. The arm part 21 and the gripper 24 are not shown. The structure is also shown separate from the beam 13. The floating structure of the intermediate part 19 is illustrated with the arrow $S_2$. The intermediate part 19 is arranged to move up and down, as shown by the arrow $S_2$, while guided by the sleeve part 18*b* of the guide 18. The fitting of the intermediate part 19 readily to the upper frame part 16 without the intermediate part 19 falling out of connection with the part 16 can be accomplished such that a screw is passed in a clearance hole of a fork part 16*b* into a screw hole in a beam 19*b* of the intermediate part 19. The clearance hole allows the floating movement $S_2$ of the intermediate part 19 along the guides 18.

Figure 3B:
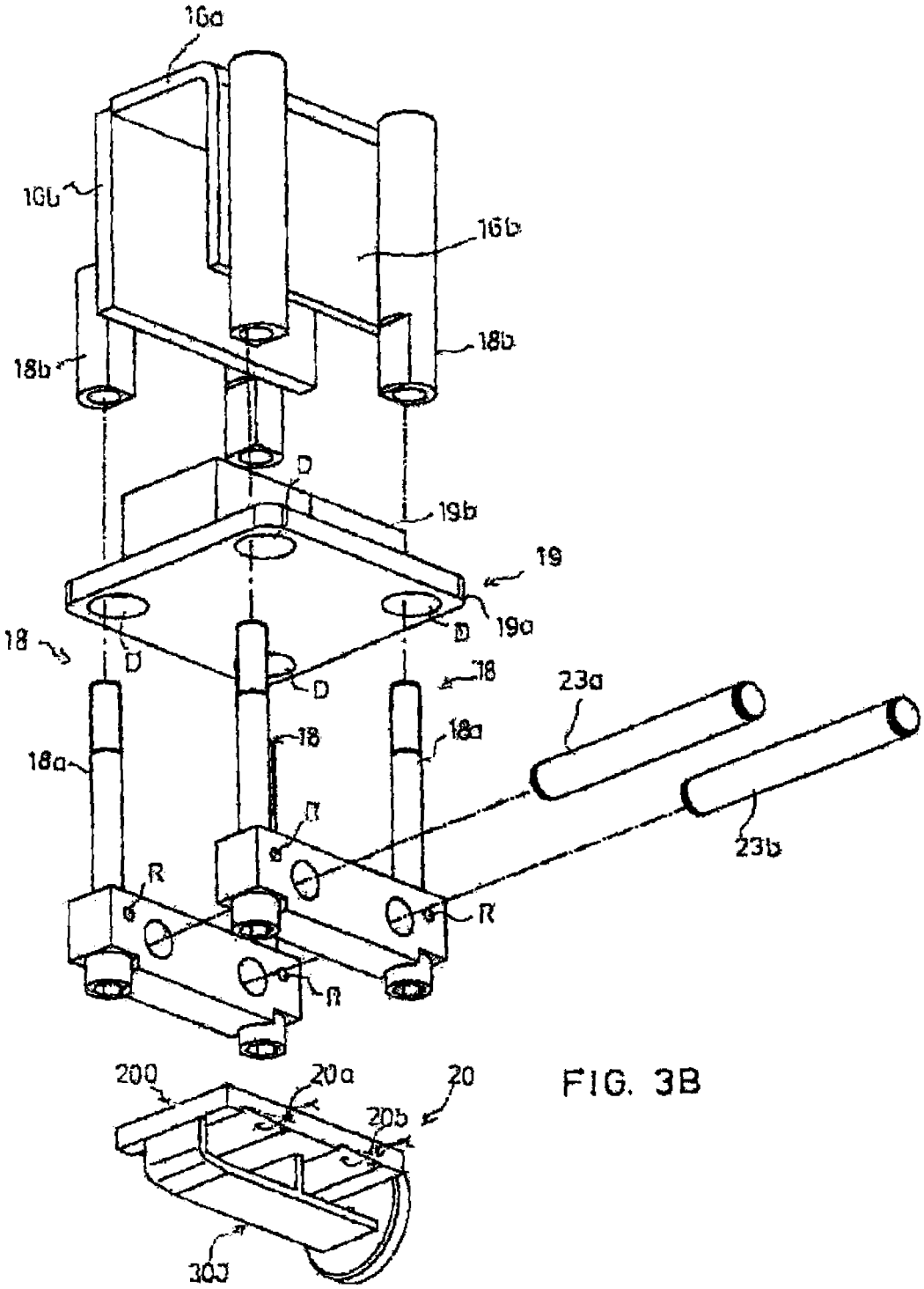
FIG. 3B shows the fastener of FIG. 3A with its parts separated from one another.

FIG. 3B shows the structural parts of FIG. 3A separated from one another in a so-called exploded view. As shown in the figures, the upper frame part 16 of the fastener 12 is connected with the lower frame part 17 through the guides 18. The intermediate part 19 is placed as a structural part against which the arm part 21 (not shown in the figure) is pressed and which is pressed against the upper surface of the beam 13 (not shown in the figure) of the straightening table 11. The rods 23*a* and 23*b* connect the side frame parts 24*a*, 24*b* of the lower frame part 17 to each other. The side frame parts 24*a*, 24*b* themselves comprise clearance holes E for the guides 18 while the diameter of a base part 180 at the end of the guides is larger than the diameter of the guide part 18 itself. The lower frame part 17 is locked to the guides 18 in a desired position by means of screws R or equivalent. The lower frame part 17 can be placed in a desired height position on the guide 18 using the screw R which is passed through a screw hole in the lower frame part and fixed to the guide 18. By this means, the lower frame part 17 can be positioned as desired on the guide in view of different sizes of the beams 13. The intermediate part 19 is a floating structure, i.e. the guides 18 are passed freely at their sleeve parts 18*b* through the through-holes D of the intermediate part. The guides 18 are fixedly attached at one end thereof by the sleeve part 18*b* to the upper frame part 16. The upper frame part is a U-shaped structure, so that the arm part 21 will be placed between the upper surface 16*a* of the upper frame part 16 the fork parts 16*b* of the frame part 16 and the intermediate part 19. The bolt part 18*a* of the guides 18 is attached to the sleeve part 18*b* of the guides 18 by means of screw threads and the sleeve part is attached further to the frame part 16. The sleeve part 18*b* is attached through casting or, for example, by welding to the upper frame part 16. The upper part of the upper frame part 16 is denoted with 16*a* and the fork parts with 16*b*. The sleeve part 18*b* is attached to the outer surface of the fork part 16*b*. The intermediate part 19 comprises a plate part 19*a* and the beam parts 19*b* that extend into the space between the fork parts 16*b* and against which the arm part 21 rests.

The lower frame part 17 comprises the side frame parts 24*a*, 24*b*, between which the wedge part 20 is arranged to be movable, the wedge part 20 comprising the wedge surfaces 20*a*, 20*b* in its one upper branch part 200, and a lower branch part 300 functioning at its end as a counter-striking surface to which a releasing blow is applied when the wedge locking is released.

The invention claimed is:

1. A fastener (12) for a car-body straightening device (10), by means of which fastener (12) a vehicle is fastened to a straightening table (11) of the car-body straightening device (10) for the time of straightening work, and which fastener (12) comprises an arm part (21) which provides additional support in the car-body straightening work when a force is applied in the straightening work to the area to be straightened, and which arm part (21) is movable in the fastener (12), and which fastener (12) can be placed on a beam (13) of the car-body straightening table (11), and moved on said beam and locked on it in a desired position, and which fastener (12) comprises a fastening device (24), such as a gripper, for fastening the fastener (12) to the car to be straightened, the fastener (12) comprises an upper frame part (16) and a lower frame part (17) of a fastener frame (15) and, between them, guides (18) to which an intermediate part (19) is connected floatingly, and that the movable arm part (21) is located between the intermediate part (19) and an upper surface (16*a*) of the upper frame part (16), and the beam (13) of the straightening table (11) is located between the intermediate part (19) and the lower frame part (17), and that there is a wedge part (20) by means of which the fastener (12) can be fastened to the beam (13) of the straightening table (11) of the car-body straightening device (10) and, at the same time, the arm part (21) of the fastener (12) can be locked in a desired position in the fastener (12), the locking of the arm part (21) to the fastener (12) and the locking of the fastener (12) in a desired position on the beam (13) of the straightening table (11) being carried out simultaneously by means of the wedge part (20), so that in the locking the intermediate part (19) is pressed against the arm part (21) and against the beam (13) of the straightening table (11).

2. A fastener (12) for a car-body straightening device as claimed in claim 1, wherein the fastener (12) comprises in the lower frame part (17) a wedge part (20) and, in the wedge part, at least one wedge surface, advantageously two wedge surfaces (20*a*, 20*b*), which are pressed in the locking against a rod/rods (23*a*, 23*b*) of the lower frame part and which are movable against them, so that when moving the wedge part (20) in one direction, the wedge part (20) is raised, and when moving in the opposite direction, the wedge part (20) is lowered over a distance corresponding to a gap between the beam (13) and the wedge part (20), so that the beam (13) of the straightening table (11) in connection with the wedge part (20) and the arm part (21) are pressed against the intermediate part (19) floating freely between the wedge part of the lower frame part (17) and the upper frame part (16), the wedge locking providing a pulling force for the guide parts (18).

3. A fastener as claimed in claim 2, wherein the guide (18) is formed of a bolt (18*a*) and an end sleeve (18*b*) to which it is attached by screw threads, and that the end sleeve (18*b*) is attached to the upper frame part (16).

4. A fastener as claimed in claim 1, wherein the lower frame part (17) comprises side frame parts (24*a*, 24*b*), between which the wedge part (20) is arranged to be movable, the wedge part (20) comprising wedge surfaces (20*a*, 20*b*) in one upper branch part (200) thereof and a lower branch part (300) functioning at its end as a counter-striking surface to which a releasing blow is applied when the wedge locking is released.

5. A fastener as claimed claim 1, wherein the guide parts (18) comprise, at their end, an end part (180) having a diameter larger than the diameter of the guide part, and that each guide part (18) is passed through clearance holes (E) in the lower frame part (17) of the fastener (12), and that there is a screw (R) by which the lower frame part (17) is locked to the guide part (18).

6. A fastener as claimed in claim 1, wherein the fastener (12) comprises a gripper (24) which is attached to the upper frame part (16) of the fastener (12) and which can be coupled by gripper jaws (25, 26) thereof to the car body, to an upper edge (K) of a sill box (H) of the car body, and that the gripper (24) comprises a downwardly extending frame part (28) and grooves ($U_1$, $U_2$) in said downwardly-extending frame part, which grooves can be brought into connection with screws (29), the screws (29) being located in the grooves ($U_1$, $U_2$. . . ), so that by using the elongate groove ($U_1$, $U_2$. . . ), the gripper (24) can be placed in a correct position on the upper edge (K) of the car sill beam (H) and, after that, the screws (29) of the gripper (24) are fastened and the gripper (24) is locked to the frame (15) of the fastener (12), advantageously to the upper frame part (16).

7. A fastener as claimed claim 1, wherein between the head of the screw (29) and the downwardly extending, frame part (28) of the gripper (24) there is an intermediate plate (30) comprising holes (F) through which the screws (29) are passed.

* * * * *